US005096442A

United States Patent [19]

Arnett et al.

[11] Patent Number: 5,096,442

[45] Date of Patent: Mar. 17, 1992

[54] COMPACT ELECTRICAL CONNECTOR

[75] Inventors: Jaime R. Arnett, Noblesville; Leonard F. Hasler, Indianapolis, both of Ind.; Ralph F. Schexnayder, Shreveport, La.

[73] Assignee: AT&T Bell Laboratories, Murray Hill, N.J.

[21] Appl. No.: 736,555

[22] Filed: Jul. 26, 1991

[51] Int. Cl.[5] ..... H01R 23/02

[52] U.S. Cl. ..... 439/676; 439/404

[58] Field of Search ..... 439/344, 676, 607-610, 439/395-407, 638, 650, 651

[56] References Cited

U.S. PATENT DOCUMENTS

| | | | |
|---|---|---|---|
| 4,208,083 | 6/1980 | Kirby | 439/395 |
| 4,337,989 | 7/1982 | Asick et al. | 439/609 |
| 5,031,310 | 7/1991 | McClean et al. | 439/676 |

*Primary Examiner*—David L. Pirlot
*Attorney, Agent, or Firm*—Michael A. Morra

[57] ABSTRACT

A compact electrical connector is formed from a metallic lead frame and a spring block. The lead frame comprises a number of flat elongated conductors, each terminating in a spring contact at one end and in an insulation-displacing connector at the other. The insulation-displacing connectors are folded around opposite side walls of the spring block to achieve compactness, and the spring contacts are folded around its front surface for insertion into a modular jack. The front surface of the spring block includes a tongue-like projection which fits into one end of a jack frame and interlocks therewith. A dielectric cover surrounds the spring block and lead frame assembly to assist in supporting the lead frame and electrically insulating it from external. Together, the spring block and jack frame comprise a standard modular jack of the type specified in the FCC Registration Rules. Up to six (6) such modular jacks can be mounted onto a single wall plate having conventional dimensions.

15 Claims, 4 Drawing Sheets

COMPACT ELECTRICAL CONNECTOR

TECHNICAL FIELD

This invention relates to an electrical connector and more particularly to modular connecting apparatus such as used by communications equipment.

BACKGROUND OF THE INVENTION

Modern communication needs have grown to the point that multiple communication outlets frequently need to be located in close proximity, at the same customer premises, in order to service multiple devices including modems, telephones and facsimile machines. It is undesirable to clutter a wall with many individual outlets, each serving a separate device. Furthermore, when multiple outlets are brought together within the same apparatus, it is generally quite difficult to make the needed wiring connections in a convenient manner. Imagine, for example, a conventional wall plate (typically $2\frac{3}{4} \times 4\frac{1}{2}$ inches) having six communication outlets, and each outlet having eight wires. Combining known communication outlets would require a substantially larger wall plate and/or lead to an uncontrolled maze of wires where the premises wiring is connected.

One known communication outlet is AT&T's 42-type connecting block which is shown in U.S. Pat. No. 4,188,505. This patent discloses an electrical connector having an input jack for receiving a modular plug, and screw-down terminals for receiving wires whose ends have been stripped of insulation. The input jack is also electrically connected to the screw-down terminals through snap-on connectors. While 42-type connecting blocks perform their intended function in an acceptable manner, a more compact connector is desired.

U.S. Pat. No. 4,261,633 discloses a Wiring Module for Telephone Jack for use in connection with a wall plate. The wiring module includes a metallic lead frame having a plurality of conductors that function as spring contacts, at one end of the lead frame, after insertion into an associated jack frame. Free-standing, electrical connecting terminals are connected to the conductors at the other end of the lead frame. The conductors of the lead frame fan out as they extend toward the connecting terminals. Nevertheless, these terminals are so close together that considerable dexterity is required for making connections by hand. Furthermore, although this wiring module achieves a degree of compactness, it appears that the associated wall plate can accept a maximum of only two modular jacks before a second wall plate is required.

U.S. Pat. No. 4,865,564 discloses a Wall Mounted Connecting Block in which the conductors of a metallic lead frame are shaped as insulation-displacing connectors, at one end of the lead frame, and function as connecting terminals to facilitate making electrical connections by hand. The entire assembly is suited for wall mounting; but unfortunately, a single modular jack fills the entire available space of a conventional wall outlet.

It continues to be a problem in the design of electrical connectors to combine compactness with convenience in making electrical connections by hand. Although such attributes are generally incompatible, they remain highly desirable.

SUMMARY OF THE INVENTION

In accordance with the invention, a metallic lead frame and a dielectric spring block cooperate to provide a compact electrical connector. The lead frame comprises a plurality of flat elongated wires, one end of which functions as spring contacts while the other end functions as connecting terminals. The connecting terminals are folded around opposite side surfaces of the spring block to achieve compactness while the spring contacts are folded around its front surface for insertion into a jack frame.

In an illustrative embodiment of the invention, the electrical connecting terminals comprise insulation-displacing connectors, each having a pair of opposing contact fingers which function to make electrical and mechanical connection to an insulated wire. The front side of the spring block includes a projection which fits into one end of a jack frame and interlocks therewith. Together, the spring block and jack frame comprise a standard modular jack of the type specified in the FCC Registration Rules. Up to six (6) such modular jacks can be mounted on a single, conventional wall plate, and fit into a "gangable single device box" such as specified in Publication OS 1 of the National Electrical Manufacturers Association (NEMA). A dielectric cover surrounds the spring block and lead frame assembly to assist in supporting the lead frame and electrically insulating it from external.

The advantages and features of the present invention will be more fully understood when reference is is made to the associated drawing and detailed description.

DETAILED DESCRIPTION

Electrical interconnection between communication equipment and premises wiring is facilitated by standardized connectors that are frequently referred to as modular plugs and jacks. Specifications for such plugs and jacks can be found in Subpart F of the FCC Part 68.500 Registration Rules. A variety of connecting blocks are available for connecting insulated wires to a jack frame including the prior art apparatus shown in FIGS. 4 and 5.

Figure 4:
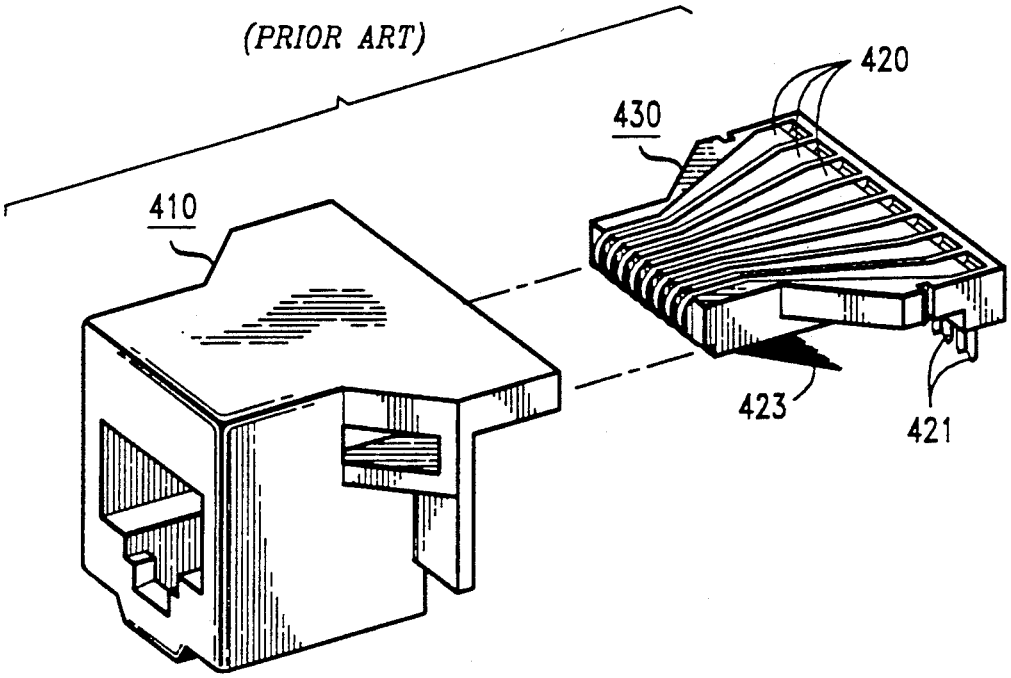
FIG. 4 (PRIOR ART)
FIG. 4 discloses a front side perspective view of a prior art electrical connector.
Figure 5:
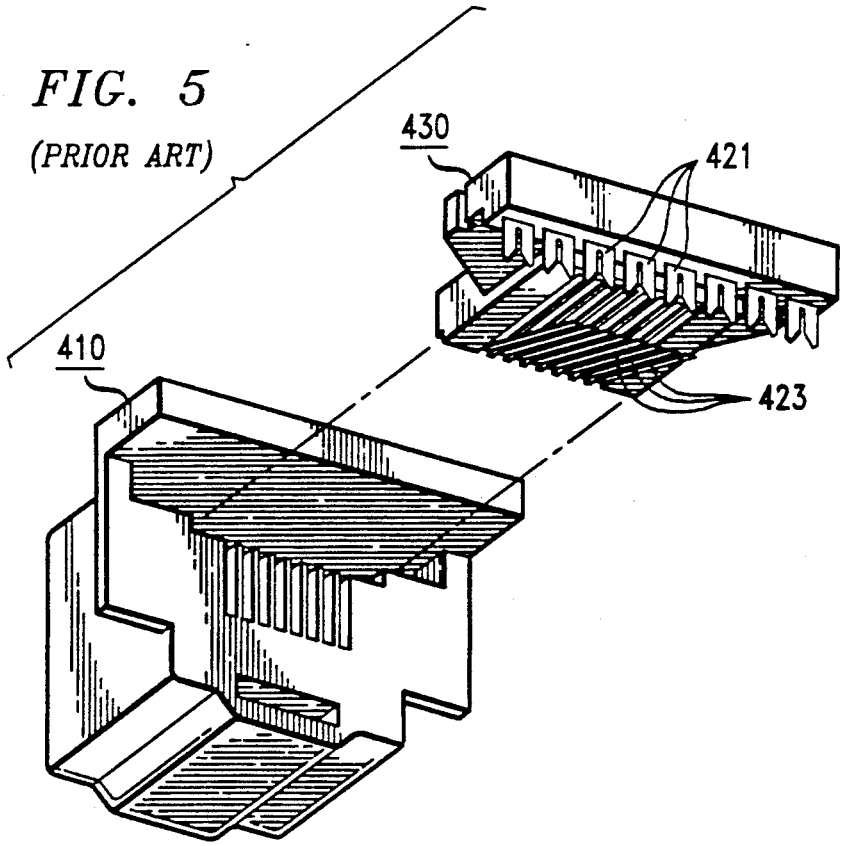
FIG. 5 (PRIOR ART)
FIG. 5 discloses a rear side perspective view of the prior art electrical connector shown in FIG. 4.

FIG. 4 discloses a top, front and right side perspective view of a jack frame 410 and spring block 430 which are joined together, as indicated, to form a modular jack. Located on spring block 430 is a metallic lead frame comprising flat elongated conductors 420 which are bent around the front side of the spring block to form spring contacts 423 at one end and electrical connecting terminals 421 at the other. The spacing between adjacent spring contacts 423 is prescribed by the FCC Registration Rules, but is so close that it is very difficult for most people to make the electrical connections with their hands in such space. Accordingly, conductors 420 fan out from the front side of the spring block as they extend toward the back side thereof where electrical connection is made to connecting terminals 421. FIG. 5 provides a bottom, back and right side perspective view of the modular jack shown in FIG. 4 comprising jack frame 410 and spring block 430. The similarity between the prior art shown in FIGS. 4, 5 and U.S. Pat. No. 4,261,633, which is discussed in the background of the invention, is noted. Although this arrangement is relatively compact, it suffers a number of disadvantages including: (i) the overall width (left side to right side) is greater than desired; (ii) attaching insulated wires to terminals 421 is inconvenient, despite the fact that the conductors 420 are fanned out, because the terminals are still too close together and too close to jack frame 410; and (iii) terminals 421 are exposed and may be easily shorted together. With these disadvantages in mind, the present invention is now discussed.

Figure 1:
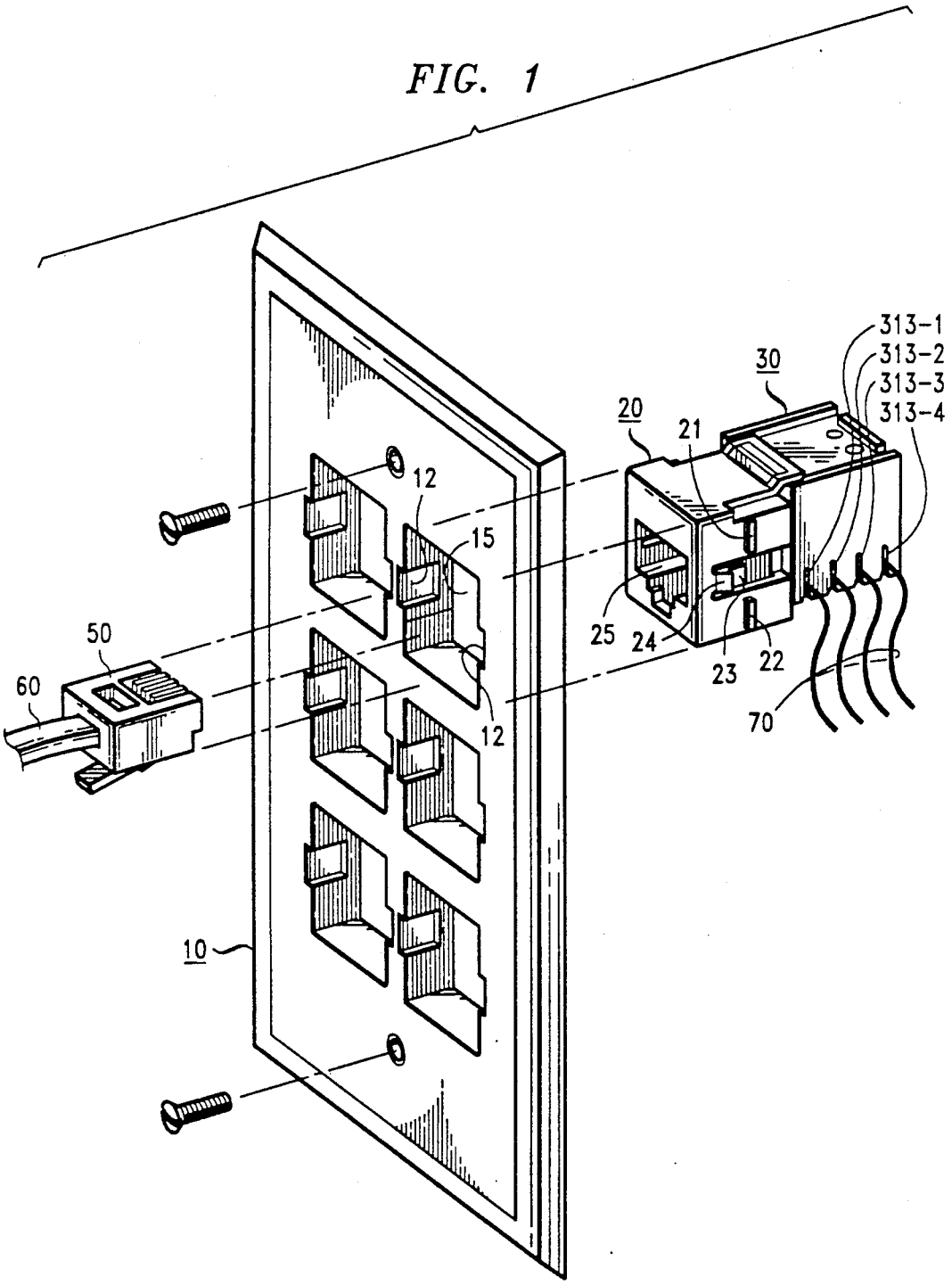
FIG. 1 discloses a wall plate receiving a compact electrical connector on one side and a modular plug on the other.

FIG. 1 discloses a wall plate 10 having conventional dimensions ($2\frac{3}{4} \times 4\frac{1}{2}$ inches) with opeings there for receiving up to six modular jacks, each comprising a jack frame 20 and a connector 30. All six modular jacks fit into a "gangable single device box" such as specified in Publication OS 1 of the National Electrical Manufacturers Association (NEMA). The NEMA box (not shown) is normally positioned directly behind wall plate 10, and has the following dimensions: 1.78 inches wide, 2.81 inches high, and 1.50 inches deep. The design of a suitable jack frame is disclosed in greater detail in application Ser. No. 569,303 filed on Aug. 8, 1990.

Each of the openings 15 in the wall plate is sized to receive jack frame 20, and includes slots 12 on opposite sides thereof for interlocking with wedge-shaped tabs 24 located on the jack frame. Flexible member 23 deflects into cavity 25 of the jack frame during its insertion into the wall plate from the back side thereof. Stop members 21, 22 preclude the jack frame from being pushed all the way through opening 15 of the wall plate. Wedge-shaped tabs 24 and stop members 21, 22 cooperate to hold the jack frame relatively immobile after insertion into the wall plate.

Inserted into opening 25, on the front side of jack frame 20, is a modular plug 50 which conveys electrical signals, through wire cable 60, to and from nearby communications equipment-typically a telephone set or data terminal apparatus. Inserted into the back side of jack frame 20 is compact electrical connector 30 which is constructed in accordance with the principles of the invention. Wires 70 are pressed into slots located on opposite side walls of connector 30 which make mechanical and electrical connection thereto. Wires 70 represent premises wiring and are individually insulated; however, this need not be the case and non-insulated wires may be used. Nevertheless, insulation-displacing connectors are located in wire-receiving slots 313-1, 313-2, 313-3 and 313-4 to remove insulation when it is present. Attention is directed to the overall width (left side to right side) and height (top side to bottom side) of the electrical connector 30. Note that it is substantially the same size (width and height) as jack frame 20 so that up to six electrical connector/jack frame assemblies can be fit into the area of a conventional wall plate. Note, too, that wire-receiving slots 313-1, 313-2, 313-3 and 313-4 are each spaced apart by a distance that allows easy insertion of wires 70. Four identical slots (not shown) are symmetrically positioned on the opposite side of connector 30. As will be discussed later in connection with FIG. 3, means are provided on the bottom side of connector 30 for facilitating wire insertion and for electrically isolating wire-ends from each other.

Figure 2:
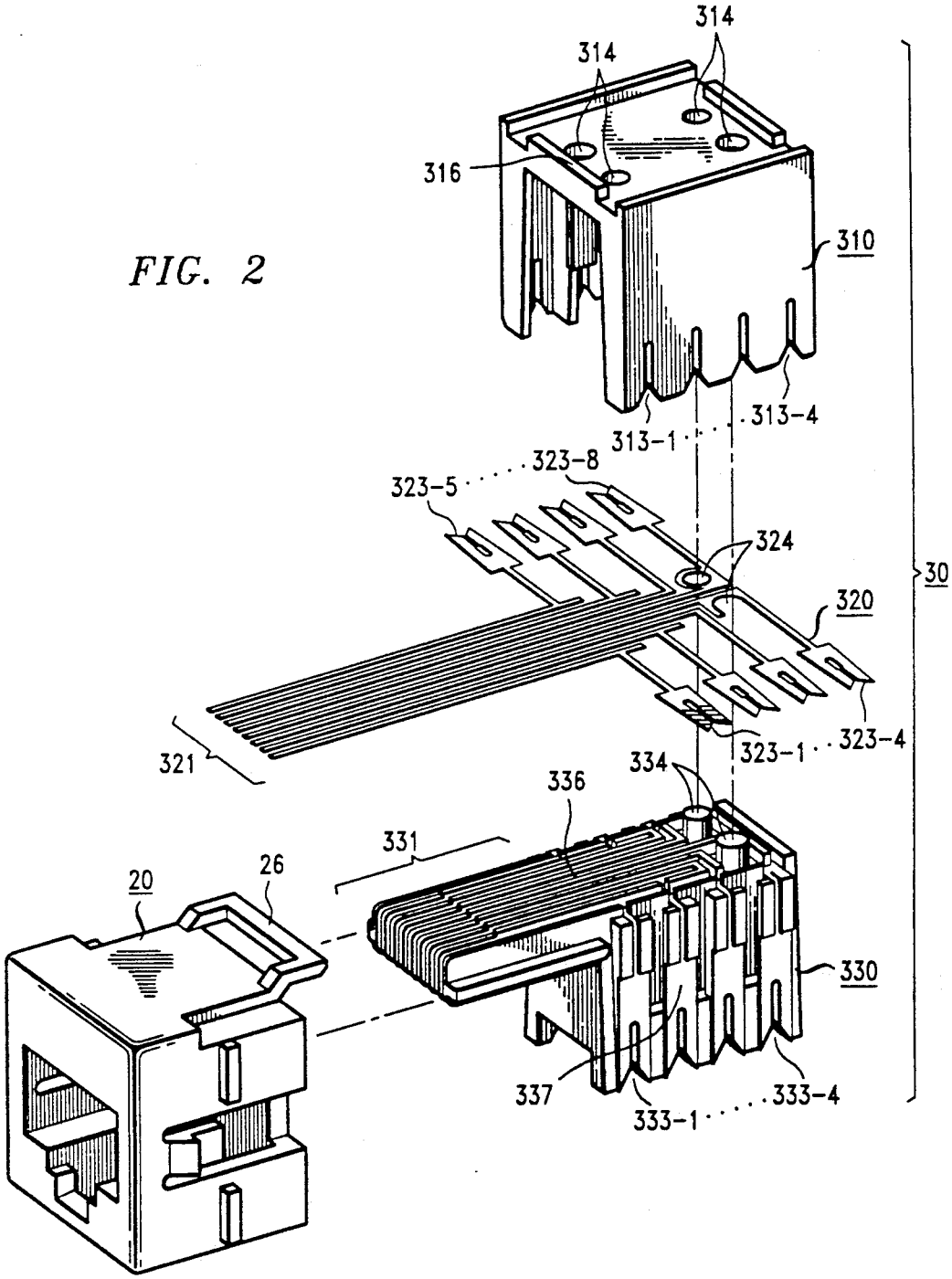
FIG. 2 discloses an exploded perspective view of a compact electrical connector in accordance with the invention.

FIG. 2 discloses an exploded perspective view of the compact electrical connector 30 and jack frame 20 showing their construction in greater detail. Electrical connector 30 comprises spring block 330, metallic lead frame 320, and cover 310 joined together as indicated. Lead frame 320 is an interconnection pattern, stamped from 0.015 inch metal stock, that is selectively gold plated in the region of spring contacts 321. Because a portion of the lead frame is used as a spring contact, the entire lead frame itself is made from a suitably flexible metal such as beryllium-copper although a variety of metal alloys can be used with similar results. Lead frame 320 is a single piece-part whose peripheral support members are not shown. It is positioned on the top side of spring block 330 which includes grooves having the same pattern as the lead frame itself. Lead frame 320 comprises eight flat, elongated conductive elements that individually interconnect one of the spring contacts 321, at one end of the lead frame, with one of the connecting terminals 323-n at the other end, where n is a number between 1 and 8 inclusive. Advantageously, the connecting terminals comprise insulation-displacing connectors which provide reliable connection in a small space. Holes 324 in lead frame 320 cooperate with mating pins 334 in spring block 330 to accurately position the lead frame onto the spring block. By folding insulation-displacing connectors 323-1, 323-2, 323-3 and 323-4 down one side of the spring block, and folding insulation-displacing connectors 323-5, 323-6, 323-7 and 323-8 down the other, a substantial improvement in the compactness of such connectors is achieved. Additionally, the end of the lead frame used for spring contacts 321 is wrapped around tongue-like protrusion 331 of the spring block 330. Once the lead frame is in place on the top surface 336 of the spring block, heat is applied to its grooves, via ultrasonic welding, in order to deform the thermoplastic material from which spring block 330 is made to thereby permanently join the lead frame and spring block together. In the present embodiment, spring block 330, cover 310, and jack frame 20 are all made from a thermoplastic material such as Polyvinyl Chloride (PVC).

After the insulation-displacing connectors 323-1, 323-2, 323-3 and 323-4 of the lead frame are folded around side wall 337 the spring block, the spaces between the opposing contact fingers, that form the insulation-displacing connectors, are aligned with wire-receiving slots 333-1, 333-2, 333-3 and 333-4 of the spring block so that a wire may pass therebetween. Similarly, insulation-displacing connectors 323-5, 323-6, 323-7 and 323-8 are folded around the other side wall 338 (see FIG. 3) of the spring block, the spaces between the opposing contact fingers being aligned with wire-receiving slots 333-5, 333-6, 333-7 and 333-8 (see FIG. 3) of the spring block. Side walls 337 and 338 are substantially parallel to each other and perpendicular to the top surface 336 of the spring block. Furthermore, when cover 310 is joined with spring block 330, its slots 313-n are aligned with the spaces between opposing contact fingers of the insulation-displacing connectors 323-n. As a result, the insulation-displacing connector is sandwiched between the spring block and cover, and protected from the possibility of an inadvertent electrical short between adjacent connectors. After the cover is joined with the spring block, the pins 334 in the spring block protrude through two of the holes 314 in the cover. These pins are heated and deformed, via ultrasonic welding, to permanently join the cover to the spring block. Cover 310 includes four symmetrically-positioned holes 314 so that it can be interlocked with the spring block in either of two ways. Compact electrical connector 30 may now be inserted into jack frame 20 which includes latch 26 that cooperates with shoulder 316, molded into the top of cover 310, to interlock the two together.

Figure 3:
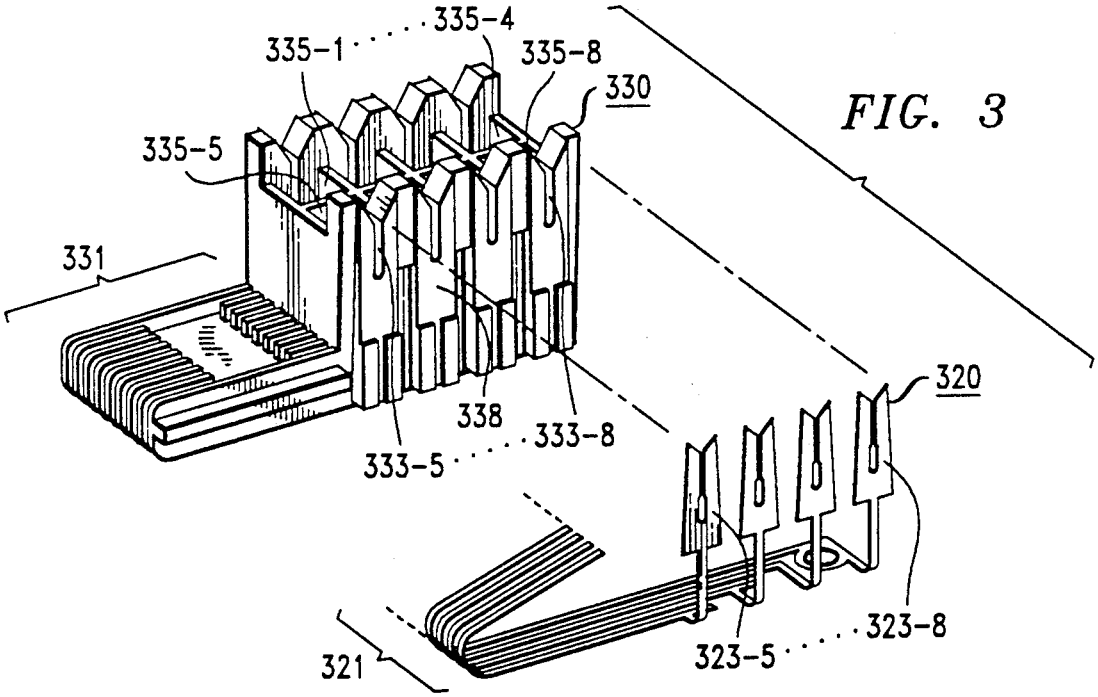
FIG. 3 illustrates the relationship between the spring block and the lead frame used in the compact electrical connector of the present invention.

Referring now to FIG. 3 there is provided a more detailed view of spring block 330 and the portion of lead frame 320 that interfaces with side wall 338 of the spring block. The lead frame is shown in its folded position for achieving compactness; however, by placing only four of the insulation-displacing connectors along each of two opposite side walls of the spring block, wiring convenience is also achieved. Associated with each of the insulation-displacing connectors 323-n is a corresponding wire-receiving slot 333-n and wire compartment 335-n in the spring block. It is noted that each wire compartment 335-1 through 335-8 comprises a dielectric cavity for receiving the end portion of a wire. During wire installation, a wire end is inserted into wire compartment 335-8, for example, while the wire itself is bent around, and pulled down into, wire-receiving slot 333-8 where it makes electrical and mechanical connection with the opposing contact fingers of insulation-displacing connector 323-8.

In summary, by positioning electrical connecting terminals along opposite side walls of a dielectric spring block, compactness is achieved. By molding wire compartments into the spring block in the region between its side walls, a convenient receptacle for wire ends is formed. By providing each wire compartment with a wire-receiving slot that includes an insulation-displacing connector, the ability to make wire connections by hand is improved. Such wire connections may be made when the connector assembly 20, 30 is joined with the wall plate 10 or when it is separated from it.

Although a particular embodiment of the invention has been disclosed, it is understood that various modifications are possible within the spirit and scope of the invention. These modifications include, but are not limited to, the use of connecting terminals other than insulation-displacing connectors, the use of a spring block which has no wire compartments or grooves, the use of dielectric material other than PVC, and the use of the compact electrical connector without a dielectric cover or with a cover that is integrally molded into the spring block.

We claim:

1. In combination:

a metallic lead frame comprising a plurality of flat elongated wires for communicating electrical signals, each of said wires terminating at one end in spring contacts and at the other end in a connector terminal; and a dielectric spring block comprising top, bottom, front, left-side and right-side surfaces, each of the side surfaces being substantially parallel to each other and each including a slot for receiving a wire, the metallic lead frame being positioned on the top surface of the spring block and folded around its front, left-side and right-side surfaces; whereby a compact electrical connector assembly is formed.

2. The combination of claim 1 wherein the spring block includes grooves on its top, front, right-side and left-side surfaces for receiving the lead frame and for holding it in a fixed position.

3. The combination of claim 1 wherein the bottom surface of the spring block includes one cavity associated with each of the side slots, said cavities being positioned to hold the ends of wires that are inserted into the grooves; whereby the cavities provide electrical insulation between the wires.

4. The combination of claim 1 wherein each of the connector terminals comprises a pair of opposing contact fingers, said contact fingers operating to displace insulation from wires pressed therebetween and to make mechanical and electrical connection with the wire.

5. The combination of claim 4 further including a dielectric cover surrounding the spring block on its top, left-side and right-side surfaces, and capturing the lead frame between itself and the spring block, the portion of the dielectric cover which covers the side surfaces of the spring block including corresponding slots which align with the slots in the spring block and with the openings between pairs of contact fingers.

6. The combination of claim 1 wherein the front surface of the spring block includes a tongue-like projection around which the spring contacts of the lead frame are folded, said projection being shaped for insertion into an opening in a jack frame; whereby a compact electrical plug is formed.

7. The combination of claim 6 further including a dielectric jack frame having front and back surfaces and an opening that extends therebetween, the opening in the front surface being adapted to receive an electrical plug inserted therein, and the opening in the back surface being adapted to receive the projection in the spring block; whereby a compact electrical jack is formed.

8. The combination of claim 7 further including a dielectric cover surrounding the spring block on its top, left-side and right-side surfaces, and capturing the lead frame between itself and the spring block, the dielectric cover including a first latching means which cooperates with a second latching means on the jack frame, said first and second latching means cooperating to hold the cover and jack frame together.

9. The combination of claim 7 wherein the left-side to right-side width of the spring block and cover assembly is substantially the same as the left-side to right-side width of the jack frame.

10. The combination of claim 7 wherein the top to bottom width of the spring block and cover assembly is substantially the same as the top to bottom width of the jack frame.

11. The combination of claim 7 wherein the opening in the front surface of the jack frame is adapted to receive a modular telephone plug of the type specified in Subpart F of the FCC Part 68.500 Registration Rules.

12. A compact electrical jack comprising a lead frame, a spring block and a jack frame, the lead frame comprising:

a plurality of flat elongated electrical conductors, each being terminated in a spring contact at one end and in an insulation-displacing connector at the other;

the spring block comprising:

a dielectric structure having left-side and right-side walls that are parallel to each other, top and bottom surfaces that are parallel to each other but perpendicular to the side walls, and a front surface that includes a tongue-like projection; the lead frame being positioned on the top surface of the spring block with its insulation-displacing connectors folded onto its left-side and right-side walls, and its spring contacts folded around its tongue-like projection; and the jack frame comprising:

a dielectric structure having front and back surfaces and an opening that extends therebetween, the opening in the front surface being adapted to receive and electrical plug inserted therein, and the opening in the back surface receiving the tongue-like projection in the spring block; whereby a compact electrical jack is formed.

13. A compact electrical plug comprising a lead frame, a spring block and a cover, the lead frame comprising:

a plurality of flat elongated electrical conductors, each being terminated in a spring contact at one end and in an insulation-displacing connector at the other;

the spring block comprising:

a dielectric structure having left-side and right-side walls that are parallel to each other, top and bottom surfaces that are parallel to each other but perpendicular to the side walls, and a front surface that includes a tongue-like projection; the lead frame being positioned on the top surface of the spring block with its insulation-displacing connectors folded onto its left-side and right-side walls, and its spring contacts folded around its tongue-like projection; and the cover comprising:

a dielectric structure having left-side and right-side walls that are parallel to each other but perpendicular to a top surface that structurally joins the side walls; the cover being joined to the spring block in a manner such that the lead frame is captured between the cover and the spring block, whereby a compact electrical plug is formed.

14. A connector assembly comprising:

a dielectric spring block having left-side and right-side walls that are parallel to each other, top and bottom surfaces that are parallel to each other but perpendicular to the side walls, and a front surface that includes a tongue-like projection, said spring block including first and second rows of cavities in the bottom surface of the spring block that are positioned along its side walls, each of the cavities including a wire-receiving slot that extends through the side wall; and a metallic lead frame having a plurality of flat elongated electrical conductors, each conductor being terminated in a spring contact at one end and in an insulation-displacing connector at the other, the conductors being positioned on the top surface of the spring block, the spring contacts being wrapped around the tongue-like projection in the front surface of the spring block, and the insulation displacing-connectors being positioned to make electrical connection with wires pressed into said wire-receiving slots.

15. The connector assembly of claim 14 further comprising a dielectric jack frame having front and back surfaces and an opening that extends therebetween, the opening in the front surface being adapted to receive an electrical plug inserted therein, and the opening in the back surface being adapted to receive the tongue-like projection in the spring block.

* * * * *